United States Patent [19]

Harrington

[11] Patent Number: 5,033,172

[45] Date of Patent: Jul. 23, 1991

[54] REWETTABLE POLYOLEFIN FIBER AND CORRESPONDING NONWOVENS

[75] Inventor: James H. Harrington, Gwennett County, Ga.

[73] Assignee: Hercules Incorporated, Wilmington, Del.

[21] Appl. No.: 359,617

[22] Filed: Jun. 1, 1989

[51] Int. Cl.[5] ..... B32B 5/06; D04H 1/54; D04H 1/60; D04H 3/10; D04H 3/14

[52] U.S. Cl. ..... 28/107; 156/62.4; 156/73.1; 156/244.17; 156/244.18; 156/244.26; 156/272.8; 156/283; 428/286; 428/288; 428/296; 428/373; 264/DIG. 47

[58] Field of Search ..... 156/62.4, 73.1, 244.17, 156/244.18, 244.26, 272.8, 283; 28/107

[56] References Cited

U.S. PATENT DOCUMENTS

| | | | |
|---|---|---|---|
| 4,035,229 | 7/1977 | Rave | 162/167 |
| 4,082,730 | 4/1978 | Rave | 162/167 |
| 4,098,757 | 7/1978 | Gordon . | |
| 4,154,647 | 5/1979 | Rave | 162/157 |
| 4,273,892 | 6/1981 | Rave | 525/180 |
| 4,578,414 | 3/1986 | Sawyer et al. | 524/310 |
| 4,636,436 | 1/1987 | Clementini et al. | 428/364 |
| 4,637,945 | 1/1987 | Masui et al. | 428/290 |
| 4,702,947 | 10/1987 | Pall et al. | 428/36 |
| 4,806,411 | 2/1989 | Mattingly et al. | 428/139 |

OTHER PUBLICATIONS

*Chemical Abstracts* 109(6):38983
*Chemical Abstracts* 104(18):150706.
*Chemical Abstracts* 96(2):7348.
*Chemical Abstracts* 91(10):75300.
*Chemical Abstracts* 82(2):4988.
*Chemical Abstracts* 102(4):26234.

*Primary Examiner*—James C. Cannon
*Attorney, Agent, or Firm*—John E. Crowe

[57] ABSTRACT

A method and corresponding product whereby hydrophobic polyolefin-containing nonwoven materials are provided with sustainable hydrophilic properties for rewet purposes by incorporation into the appropriate spin melt composition an effective amount of an alkoxylated fatty amine in optional combination with up to 60% by weight of primary fatty acid amide.

19 Claims, No Drawings

REWETTABLE POLYOLEFIN FIBER AND CORRESPONDING NONWOVENS

The present invention relates to a method for imparting sustainable hydrophilic properties to polyolefin-containing hydrophobic fiber and film, and to the corresponding fiber and nonwoven material obtained therefrom by incorporating one or more of a defined class of tertiary amines within the appropriate spin or cast melt resin composition.

BACKGROUND

While the manufacture and various uses of polyolefin-based fiber, fibrillated film, webs and corresponding nonwoven materials are well known in the textile art, attempts to broadly apply such knowledge to produce products in the area of personal hygiene, such as cover stocks for catamenial devices, disposable diapers, incontinence pads and the like, have met with limited success at best.

In general, such products must have a fluid-absorbent core, usually comprising one or more layers of fluid absorbent material such as wood pulp, rayon, gauze, tissue or the like, and, in some cases, synthetic hydrophilic material such as hydrophilic polyurethane foam.

The fluid-absorbing material is generally provided in the form of a thermally bonded pad, of wood pulp, fiber and conjugate fiber, which may have a rectangular or somewhat oval shape. To protect the clothing or areas around the user from being stained or wetted by fluids absorbed by the pad, it is generally backed by a fluid-impervious barrier sheet. In general, the absorbent product is positioned against the body with hydrophilic material facing and contacting the body and the fluid impervious barrier layer facing the outside.

To enhance a sense of comfort, such absorbent products also generally employ a facing or cover stock material which covers the body-facing surface of the product. The purpose of this cover is two-fold, namely (1) to structurally contain a loosely packed core of absorbent material as above described and (2) to protect the body from continued direct contact with the wetted absorbent material. The facing or cover stock must, therefore, be very pervious to fluids on the side of the product that is placed against the body, and yet be essentially nonabsorbent, so as to actively promote the immediate transfer of substantially all of the fluid into the absorbent core material with minimal surface fluid retention by the cover stock and minimal lateral migration of fluid along the cover stock surface.

Such material should also feel smooth and soft to the touch. In addition, certain additional characteristics are also sometimes desired, such as visual opacity plus specific coloring and luster on the outer surfaces.

In order to obtain many of above-listed characteristics, however it is imperative that cover stock utilizing essentially hydrophobic polymeric material, such as polyolefin fiber or film, be made at least temporarily hydrophilic and have the continuing ability to pass aqueous fluids through, even after several insults (i.e. wettings) without wash out or leach out of hydrophilic-promoting agents. This is particularly important in the case of diaper cover stock so as to avoid lateral liquid migration and side leakage without interfering with fabric bonding steps or wet strength of the final product.

Based on teaching in the paper-making art, it is known that short term hydrophilicity can be imparted to hydrophobic polymers such as polyolefin fiber by using flash evaporation techniques and treating the resulting fiber or filament with hydrophilizing agents such as polyvinyl alcohol or various nitrogen-containing water-soluble polymers (ref. U.S. Pat. Nos. 4,156,628, 4,035,229, 4,082,730, 4,154,647, 4,156,628, 4,035,229, 4,273,892 and 4,578,414).

For personal hygiene purposes, however, the lack of significant resistance to wash out and leaching of the art-recognized hydrophilic-promoting additives, plus interference with fiber or web bonding properties under high speed commercial operation, has justified continuing attempts to obtain improved additives and a longer term wettability. Such efforts include incorporating alkoxylated alkylphenols or corresponding polyoxyalkylenes into spun melt compositions (ref. U.S. Pat. No. 4,578,414). Serious high speed bonding and fluid control problems remain, however.

It is an object of the present invention to more effectively utilize inert hydrophobic polyolefin-containing nonwoven materials in the area of personal hygiene.

It is a further object of the present invention to efficiently utilize polyolefin-containing webs comprised of fiber, and/or fibrillated film as cover stock.

It is a still further object to obtain and retain hydrophilicity and liquid strike through properties in strong well bonded nonwoven hydrophobic materials such as continuous and/or staple fiber utilizing polyolefin component(s).

THE INVENTION

It is now found that hydrophilicity and liquid strike through properties of fiber (both continuous and staple), fibrillated film and corresponding nonwoven materials, particularly those comprised of essentially hydrophobic polyolefin-containing web(s) of fiber and/or fibrillated film, can be obtained and retained for an extended period by incorporating into the corresponding polyolefin-containing cast- or spin-melt composition, an effective amount of a modifier composition comprising (a) at least one N,N-polyalkoxylated 10–22 carbon fatty acid amine, inclusive of amines having 12–20 carbon and preferably 18 carbon linear straight chain moiety such as octadecyl amine or octadecenyl amine; and (b) up to about 60%, and preferably 0–45% by weight of modifier composition, of a primary or secondary 10–22 carbon fatty acid amide such as stearamide.

After spinning or casting the resulting melt to obtain fiber or film, and processing the fiber (i.e. cutting and carding and/or spun bonding or melt blown) or fibrillated film in accordance with art-recognized techniques (ref U.S. Pat. Nos. 4,310,594 and 3,576,931), the corresponding webs can be oriented and bonded by conventional means to obtain the desired nonwoven material.

Such treated fiber can, if desired, be of a continuous or staple bicomponent fiber such as a sheath/core variety in which the polyolefin sheath spun melt contains the modifier composition or of the homogeneous (e.g. monoolefin) type.

For present purposes the term "effective amount", as above utilized, is construed as falling within a range of about 0.1%–4.0% and preferably about 0.5–2.0%, based on melt weight.

In particular, fiber, fibrillated film and corresponding hydrophobic nonwovens obtained therefrom are successfully modified by incorporating into the spun melt a modifier composition in which the above-defined "(a)" component is also conveniently represented as at least one alkoxylated amine compound of the general formula

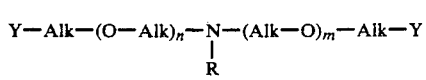

(1)

or

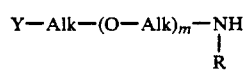

(2)

wherein the

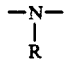

group is a 10–22 carbon fatty amine moiety in which

R has a linear configuration of a tallow amine, or a fatty amine wherein the fatty group is decyl, dodecyl, hexadecyl, tetradecyl, octadecyl, eicosyl, or octadecenyl;

Alk is defined as a 2–4 carbon methylene chain;

n and m are individually defined as a number ranging from about 0–26; which, in combination, are commensurate with a molecular weight within a range of about 258 to about 2000; and Y is defined as a hydrophilic chemical end group such as —OH, —$SO_4$— and the like.

The optional "(b)" amide component of the modifier composition is preferably a primary or secondary fatty acid amide, such as one or more compound represented by the formulae

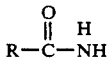

(3)

or

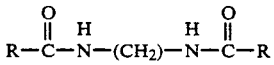

(4)

wherein

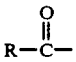

is individually defined as a 10–22 carbon fatty acid acyl moiety. Representative acids are, for instance, capric, palmitic, behenic, stearic and oleic acids, or corresponding N,N'-ethylene bis counterparts as noted in formula (4).

For present purposes, the above-defined modifier composition is best applied as a dry powdered ethoxylated amine material commercially obtainable, for instance, as Kemamine® AS-990, 974, 989, and 650(*1) alone or combined with up to 60% by modifier composition weight of a fatty acid amide such as Kemamide® S, or B(*1), and blended with a suitable polyolefin aresin, in flake or pellet form, exemplified by an isotatic polypropylene or art-recognized hydrophobic copolymers thereof, the melt preferably having a weight average varying from about $3\times10^5$ to about $5\times10^5$, a molecular weight distribution of about 5.0–8.0, a melt flow rate of about 2.5 to about 4.0 g/10 minute, plus a spin temperature of about 220° C.–300° C. Such parameters can be modified, if necessary, to favor melt blown nonwovens and to obtain particularly desired characteristics such as high wet strength, softness, ease in using for high speed production, and the like.

*1 Commercial products of Humko Chemical Division of Witco Chemical Company of Memphis, Tenn.

As above noted, hydrophilic-induced webs used to fabricate nonwoven material such as cover stock can also usefully comprise conventional sheath/core or side-by-side bicomponent fiber or filament, alone or combined with treated or untreated homogenous-type fiber or filament and/or fibrillated film.

When using webs containing fiber of a sheath/core configuration, however, it is found particularly advantageous to incorporate the above-defined modifier composition primarily in the sheath component in order (a) to maximize surface availability, (b) to favor fiber surface-directed migration of the modifier and (c) to minimize the total amount of modifier composition required.

Also within the scope of the present invention is the use of nonwovens comprised of one or more bonded webs of modifier-treated polyolefin fiber- and/or fiber-like (fibrillated film) components having a mixed fiber denier of homogeneous and/or bicomponent types not exceeding about 40 dpf. Such webs preferably utilize fiber or filament within a range of about 0.1–40 dpf.

For present purposes, webs used to form nonwovens, within the scope of the present invention are usefully formed by "Wet" or "Dry" Process and bonded together using bonding techniques with adhesive binders (U.S. Pat. No. 4,535,013), thermal bonding using calender rolls, hot air, sonic, laser, powder bonding, needle punch bonding and the like, known to the art.

In addition, the resulting nonwoven material can be embossed and/or calender printed conventionally with various designs and colors, as desired, to increase loft, augment wet strength, and provide easy market identification.

Also includible within the instant invention are fibers utilizing art-recognized additives including pH stabilizers such as calcium stearate, antioxidants, degrading agents, pigments, including whiteners and colorants such as $TiO_2$ and the like. Generally such additives can individually vary, in amount, from about 0.1%–3% by weight of spin melt.

In addition, webs used in forming nonwovens within the scope of the present invention are generally produced from one or more types of conventionally spun fibers or filaments having, for instance, round, delta, trilobal, or diamond cross sectional configurations.

Nonwoven cover stock of the above-defined types can usefully vary in weight from about 10–40 gm $yd^2$ or even higher.

The following examples further illustrate, but do not limit the present invention:

EXAMPLE 1

A. Polypropylene in flake form and characterized as follows: (crystallinity 60%, $M_w$ $3.5\times10^5$, molecular weight distribution 6.4, and melt flow 3.2 g/10 minutes) is mixed in an impact blended at high speed for 20 minutes with 0.5% by weight of powdered Kemamine® AS 990(*2) as modifier composition. After blending, the mixture is fed into a 1 ½" extruder and spun through a 210 hole spinnerette at 285° C., air quenched, and processed to obtain 2.2 dpf 1.5" staple filament. The filament is then carded into webs weighing about 20 g/$yd^2$ and conventionally calendar bonded at 164° C. to obtain sample nonwoven material, which is then cut into test strips identified as A-1 for stroke through, rewet and tensile-strength tests using Syn-Urine TM (*3). Test results are reported in Table I below as sample A-1, the control sample (C-1) being identically prepared and tested except for the absence of Kemamine 990 in the fiber.

(*2) an ethoxylated stearyl amine obtained commercially from Humko Chemical Division of Witco Chemical Corporation.

(*3) an aqueous commercial product obtained from Jayco Pharmaceutical Company of Camp Hill, PA.

B. Filaments, webs and nonwoven materials are obtained in accordance with Example 1A, by incorporating 1.0% by weight of Kemamine AS 990 in the spun melt as modifier composition. The resulting 2.2 dpf fiber is cut to 1 ½ inch staple, carded into webs and thermally bonded as before to obtain a 20 g/yd$^2$ test nonwoven.

Strips of this nonwoven, identified as B-1, are tested for strike through, rewet, and strength as before; and results reported in Table 1.

C. Monofilament of 6 dpf are prepared, using the polypropylene flake of Example 1A admixed respectively with 0.5%, 1% and 2% by weight of Kemamine AS 990. Five (5) gram samples if each filament are loosely packed into identical 3 gram mesh baskets for sink-time tests in accordance with ASTM Method D-1117-79, increases in sink time or submergence time, after repeated insults being correlated to the degree of wash out and loss of hydrophilicity. Test results are reported in Table 2 as Samples D-1 through D-3 and the control (no modifier) is reported as C-2.

D. A bicomponent sheath/core polypropylene fiber of 6 dpf is prepared having a 30 wt % sheath, is prepared from isotactic polypropylene flake of Example 1A which is blended with 1% by polymer weight of Kemamine AS 990 and spun at 250° C. as a sheath or cover. The corresponding 70 wt. % or core is obtained from the corresponding unmodified isotactic polypropylene of Example 1A using an art-recognized spin pack arrangement (ref U.S. Pat. No. 3,700,544).

The resulting bicomponent fiber and modified homogeneous polypropylene fiber as (control) are tested in the manner of Example 1 C with respect to sink time, strike through, and rewet, and test results reported in Tables 3 and 4 as E-1 and C-3 (control).

E. Two batches of continuous spun isotactic polypropylene fiber containing, respectively 0.5% and 1.0% Kemamine modifier composition are prepared and spun (2.2 dpf) in accordance with Example 1 A, some of the fiber being crimped, cut, to 1.5" staple, carded, and the resulting web thermally bonded as before to obtain test nonwoven material. The fiber, yarn and strips of nonwoven (20 gm/yd$^2$) are then tested for sink time as before, using identical weight samples lightly packed into 3 gram mesh basket. Test results are reported in Table 5 below.

TABLE 1

| Sample # + Additive | # of insults | Strike-through (sec) | Strike Time (sec) Rewets | Rewets (g) | Tensile Strength (g/inch) (CD) | (MD) (g/inch) |
|---|---|---|---|---|---|---|
| A-1 | 1 | 1-7 | 2.1 | .11 | 542 | 2198 |
| .5% | 2 | 2.1 | 2.4 | .10 | " | " |
| Kemamine ® | 3 | 1.9 | 5.7 | .10 | " | " |
| | 4 | 3.0 | 6.2 | .10 | " | " |
| | 5 | 4.5 | 15.0 | .10 | " | " |
| C-1 | 1 | 1.9 | 1.6 | .10 | 517 | 2015 |
| (Control) | 2 | 21.0 | >5 min | — | " | " |
| | 3 | 122.0 | — | — | " | " |
| | 4 | 283.0 | — | — | " | " |
| | 5 | 290.0 | — | — | " | " |
| B-1 | 1 | 1.8 | 1.8 | .10 | 565 | 2628 |
| | 2 | 1.8 | 2.8 | .10 | " | " |
| | 3 | 2.4 | 4.0 | .10 | " | " |
| | 4 | 4.2 | 10.0 | .10 | " | " |
| | 5 | 3.3 | 11.0 | .10 | " | " |

TABLE 2

| Sample # | % Kemamine ® 900 | Type | Insults | Sink Time (Sec) |
|---|---|---|---|---|
| C-2 | 0 | Monofil. | 1 | Did not sink |
| D-1 | 0.5#4 | " | 1 | 1.0 |
| | | " | 2 | 1.5 |
| | | " | 3 | 3.2 |
| | | " | 4 | 5.4 |
| | | " | 5 | 4.8 |
| D-2 | 0.5 | " | 1 | 31.0 |
| | | " | 2 | 20.0 |
| | | " | 3 | 6.4 |
| | | " | 4 | 14.7 |
| | | " | 5 | 20.0 |
| D-3 | 1.0 | " | 1 | 6.0 |
| | | " | 2 | 7.8 |
| | | " | 3 | 7.7 |
| | | " | 4 | 6.5 |
| | | " | 5 | 4.9 |
| D-4 | 2.0 | " | 1 | 11.0 |
| | | " | 2 | 4.0 |
| | | " | 3 | 12.0 |
| | | " | 4 | 5.0 |
| | | " | 5 | 5.0 |

TABLE 3

| Sample # | % Kemamine ® | Type | Insults | Sink Time (sec) |
|---|---|---|---|---|
| E-1 | 1% By Melt Wt. | Bicomp. | 1 | 1 |
| | | | 2 | 1.6 |
| | | | 3 | 3.5 |
| | | | 4 | 16.0 |
| | | | 5 | 25.0 |
| C-3 | 1% By Melt Wt. | Monofil. | 1 | 3.7 |
| | | | 2 | 2.5 |
| | | | 3 | 6.9 |
| | | | 4 | 10.5 |
| | | | 5 | 20.6 |

TABLE 4

| Sample # | % Kemamine | Type | Insults | Strike-Through (sec) | Rewet (g) |
|---|---|---|---|---|---|
| E-1 | 1%/Melt Wt. (in Sheath) | Bicomp. | 1 | 1.3 | 0.12 |
| " | 1%/Melt Wt. (in Sheath) | " | 2 | 8.3 | 0.12 |
| " | 1%/Melt Wt. (in Sheath) | " | 3 | 18.4 | 0.12 |
| " | 1%/Melt Wt. | " | 4 | 23.8 | 0.12 |

TABLE 4-continued

| Sample # | % Kemamine | Type | In-sults | Strike-Through (sec) | Rewet (g) |
|---|---|---|---|---|---|
| | (in Sheath) | | | | |
| " | 1%/Melt Wt. (in Sheath) | " | 5 | 16.7 | 0.12 |
| C-3 | 1%/Melt Wt. (in Sheath) | Homogeneous | 1 | 1.1 | 0.11 |
| " | 1%/Melt Wt. (in Sheath) | " | 2 | 2.6 | 0.12 |
| " | 1%/Melt Wt. (in Sheath) | " | 3 | 1.9 | 0.11 |
| " | 1%/Melt Wt. (in Sheath) | " | 4 | 13.1 | 0.11 |
| " | 1%/Melt Wt. (in Sheath) | " | 5 | 16.0 | 0.11 |

TABLE 5

| Samples | Sample Type | % Kemamine AS 990 Modifier | Sink Time (Sec) | No. Insults |
|---|---|---|---|---|
| F-1 (2.2 dpf) | Spin Yarn | 0.5 | 3.8 | 1 |
| | | | 3.8 | 2 |
| | | | 4.9 | 3 |
| | | | 6.9 | 4 |
| | | | 10.6 | 5 |
| F-1 | Staple | 0.5 | 8 | 1 |
| | | | 42 | 2 |
| | | | 48.7 | 3 |
| | | | 36 | 4 |
| | | | 29 | 5 |
| F-1 | Fabric | 0.5 | 6 | 1 |
| | | | 7 | 2 |
| | | | 28 | 3 |
| | | | 20 | 4 |
| | | | 30 | 5 |
| F-2 (2.1 dpf) | Spun Yarn | 1.0 | 3.1 | 1 |
| | | | 3.2 | 2 |
| | | | 3.9 | 3 |
| | | | 4.4 | 4 |
| | | | 4.5 | 5 |
| F-2 | Staple | 1.0 | 45.2 | 1 |
| | | | 105 | 2 |
| | | | 48.7 | 3 |
| | | | 67.0 | 4 |
| | | | 37.0 | 5 |
| F-2 | Fabric | 1.0 | 5.4 | 1 |
| | | | 7.7 | 2 |
| | | | 14.7 | 3 |
| | | | 28 | 4 |
| | | | 39 | 5 |
| C-4 Control (2.2 dpf) | Spin Yarn | 0.0 | 1.12 | 1 |
| | | | 4.0 | 2 |
| | | | 60.0 | 3 |
| | | | 600.0 | 4 |
| | | | >3600.0 | 5 |
| C-4 Control (2.2 dpf) | Staple | 0.0 | 1.0 | 1 |
| | | | 72.0 | 2 |
| | | | >300 | 3 |
| | | | — | 4 |
| | | | — | 5 |
| C-4 Control (2.2 dpf) | Fabric | 0.0 | 2.96 | 1 |
| | | | 600 | 2 |
| | | | >4 hrs. | 3 |
| | | | — | 4 |
| | | | — | 5 |

What is claimed is:

1. A method for obtaining and retaining hydrophilicity and liquid strike-through properties of nonwoven material from webs containing hydrophobic polyolefin components comprising incorporating into corresponding polyolefin-containing cast- or spun-melt composition an effective amount of a modifier composition comprising (a) at least one N,N-polyalkoxylated 10–22 carbon fatty amine, and (b) up to about 60%, by weight of the modifier composition, of a primary or secondary 10–22 carbon fatty acid amide;

forming fibers or a fibrillated film from the composition;

forming webs of the resulting fiber or fibrillated film and bonding at least one of said webs to obtain the desired nonwoven material.

2. The method of claim 1 wherein the hydrophobic polyolefin component(s) comprise a polypropylene homopolymer or copolymer.

3. The method of claim 1 wherein 0.1% to 4%, by weight of modifier composition, is incorporated into spun melt forming the sheath of a bicomponent fiber or filament used in forming said webs.

4. The method of claim 1 wherein 0.1% to 4%, by weight of modifier composition, is substantially uniformly incorporated throughout a homogeneous fiber and/or fibrillated film used in forming said webs.

5. The method of claim 1 wherein the (a) component of the modifier composition is an ethoxylated tetradecyl amine.

6. The method of claim 1 wherein the (a) component of the modifier composition is an ethoxylated dodecyl amine.

7. The method of claim 1 wherein the (a) component of the modifier composition is an ethoxylated eicosyl amine.

8. The method of claim 1 wherein the (a) component of the modifier composition is an ethoxylated octadecenyl amine.

9. The method of claim 1 wherein the (a) component of the modifier composition is an ethoxylated hexadecyl amine.

10. The method of claim 1 wherein the web bonding step is effected by thermal bonding.

11. The method of claim 1 wherein the web bonding step is effected by laser bonding.

12. The method of claim 1 wherein the web bonding step is effected by ultrasonic bonding.

13. The method of claim 1 wherein the web bonding step is effected by needle punch.

14. The method of claim 1 wherein the web bonding step is effected by powder bonding.

15. The method of claim 1 wherein the modifier composition comprises at least one alkoxylated amine compound of the formula $$Y-Alk-(O-Alk)_n-\underset{\underset{R}{|}}{N}-(Alk-O)_m-Alk-Y$$

or $$Y-Alk-(O-Alk)_m-\underset{\underset{R}{|}}{NH}$$

wherein the $$-\underset{\underset{R}{|}}{N}-$$

group is a 10–22 carbon fatty amine moiety in which R has a linear straight chain configuration;

Alk is defined as a 2–4 carbon methylene chain;

n and m are individually defined as a positive number ranging from about 0 to about 26, which, in combination, are commensurate with a molecular weight within a range of from about 258 to about 2000; and Y is defined as a hydrophilic chemical and group.

16. The method of claim 15 wherein the

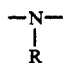

group is a tallow amine moiety, and Alk is a two carbon methylene chain.

17. The method of claim 15 wherein the

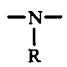

group is a fatty amine moiety is derived from a member selected from the group consisting of decyl amine, dodecyl amine, tetradecyl amine, octadecyl amine, and octadecenyl amine, and Alk is a two carbon methylene chain.

18. The method of claim 1 wherein the (b) fatty acid amide is represented by at least one compound of the formulae

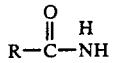

or

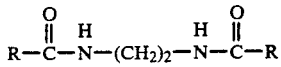

wherein

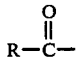

is individually defined as a 10–22 carbon fatty acid acyl moiety.

19. The method of claim 18 wherein

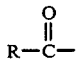

is an acyl moiety of a fatty acid selected from the group consisting of capric, lauric, myristic, stearic and oleic acid.

* * * * *

UNITED STATES PATENT AND TRADEMARK OFFICE

CERTIFICATE OF CORRECTION

PATENT NO. : 5,033,172

DATED : July 23, 1991

INVENTOR(S) : James H. Harrington

It is certified that error appears in the above-identified patent and that said Letters Patent is hereby corrected as shown below:

In the Claims, Col. 8, lines 6 and 7, "forming fibers or a fibrillated film from the composition" should read --forming fiber or a fibrillated film from the cast- or spun-melt composition--;

In the Claims, Col. 9, line 24, "moiety is derived" should read -- moiety derived--.

Signed and Sealed this

Fifth Day of January, 1993

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,033,172

DATED : July 23, 1991

INVENTOR(S) : James H. Harrington

It is certified that error appears in the above-identified patent and that said Letters Patent is hereby corrected as shown below:

In the Claims, Col. 9, line 6, "and" should read --end--.

Signed and Sealed this

Ninth Day of March, 1993

*Attest:*

STEPHEN G. KUNIN

*Attesting Officer*

*Acting Commissioner of Patents and Trademarks*